US006860676B2

(12) United States Patent
Pont Feixes

(10) Patent No.: US 6,860,676 B2
(45) Date of Patent: Mar. 1, 2005

(54) MACHINE FOR LEVELING MATERIALS ON THE GROUND

(76) Inventor: Conrado Pont Feixes, Pssg. Marques de Camps, 6 17190 Salt (Gerona) (ES)

( * ) Notice: Subject to any disclaimer, the term of this patent is extended or adjusted under 35 U.S.C. 154(b) by 16 days.

(21) Appl. No.: 10/182,626

(22) PCT Filed: Jan. 22, 2001

(86) PCT No.: PCT/ES01/00015

§ 371 (c)(1),
(2), (4) Date: Aug. 1, 2002

(87) PCT Pub. No.: WO01/57320

PCT Pub. Date: Aug. 9, 2001

(65) Prior Publication Data

US 2003/0012603 A1 Jan. 16, 2003

(30) Foreign Application Priority Data

Feb. 7, 2000 (ES) ..... 200000258 U

(51) Int. Cl.[7] ..... E01C 19/22
(52) U.S. Cl. ..... 404/118; 404/120
(58) Field of Search ..... 404/118, 120, 404/114, 75, 103, 117, 97, 101, 109

(56) References Cited

U.S. PATENT DOCUMENTS

| | | | | | |
|---|---|---|---|---|---|
| 1,782,707 | A | | 11/1930 | Bayley | |
| 3,541,934 | A | * | 11/1970 | Borquist | 404/120 |
| 3,870,427 | A | | 3/1975 | Allen | 404/103 |
| 4,465,397 | A | * | 8/1984 | Hollon et al. | 404/84.1 |
| 4,470,783 | A | * | 9/1984 | Friebel et al. | 425/62 |
| 4,655,633 | A | | 4/1987 | Somero et al. | 404/75 |
| 5,039,249 | A | * | 8/1991 | Hansen et al. | 404/84.5 |
| 5,190,400 | A | * | 3/1993 | Sterner | 404/103 |
| 5,791,815 | A | * | 8/1998 | Rowe | 404/103 |
| 6,022,171 | A | * | 2/2000 | Munoz | 404/124 |

FOREIGN PATENT DOCUMENTS

| | | | |
|---|---|---|---|
| NL | 9401774 | 6/1996 | E04G/21/10 |
| WO | 98/21418 | 5/1998 | E02F/3/36 |

* cited by examiner

*Primary Examiner*—Thomas B. Will
*Assistant Examiner*—Raymond W Addie
(74) *Attorney, Agent, or Firm*—Nath & Associates PLLC; Gary M. Nath; Jerald L. Meyer

(57) ABSTRACT

Machine to level materials on the ground, made up of an operative set which includes two parallel telescopic arms (4), which are incorporated in revolving disposition on a bearing structure (1), while on the end of the arms in articulated fastening a horizontal head (6) is situated, foreseen of means to distribute, level and compact materials to be applied on the ground.

8 Claims, 7 Drawing Sheets

MACHINE FOR LEVELING MATERIALS ON THE GROUND

The levelling of material extended on the ground is a usual operation in certain kinds of works, such as the building of roads, when carrying out pavements, agricultural conditioning, etc . . . , for which machines are used which are especially designed and equipped for the mentioned function.

A realization of the mentioned machines consists in a distributing head of the spread material, being the mentioned head incorporated on a supporting arm, by means of which it can be manoeuvred to carry out the necessary operations.

In this respect, the existing machines suffer however from operative inconveniences, due to the instability of the head fastening due to the fact the head is supported by an only supporting arm.

In front of it, according to the present invention a machine is proposed which is developed according to a structural realization which offers very advantageous functional features referring to the operative function of the levelling jobs to be carried out of materials on the ground.

This machine, object of the invention includes a head, situated on a support by means of two parallel telescopic arms, which can be commanded from the functional body of the machine, being the mentioned arms able to turn together and at the same time, individually in their elongation.

This way, a very resistant machine structure is reached, with which the head is fastened in a very stable way, allowing to operate with the head in a wide field from the machine positioning on, with the possibility to manoeuvre laterally by means of the swinging of the set of arms and frontally by means of the extension and withdrawal of both arms, while by means of the individual extension and withdrawal of the arms the positioning of the head with the suited transverse inclination can be carried out.

The head is foreseen of some worm and rollers to move the material to be levelled according to a uniform surface distribution, including a screeding board which cooperates in the uniform levelling of the material, while, by means of a vibrating longitudinal beam a compacting of the levelled material is carried out.

The mentioned head is fixed with respect to the supporting arms by means of a hanging disposition, including some security hitches and a fastening by means of anchoring with wedges, which determines a completely secure and stable fastening, allowing an easy disassembly for the transport.

Respect to the fastening support the head remains hung by means of some cylinders, by means of which the high positioning can be regulated, to work at the same level or at different levels from where the machine is situated.

In view of all this the mentioned machine object of the invention certainly has some very advantageous features, acquiring own life and preferable character with respect to the machines which at present exist for the same function.

Figure 1:
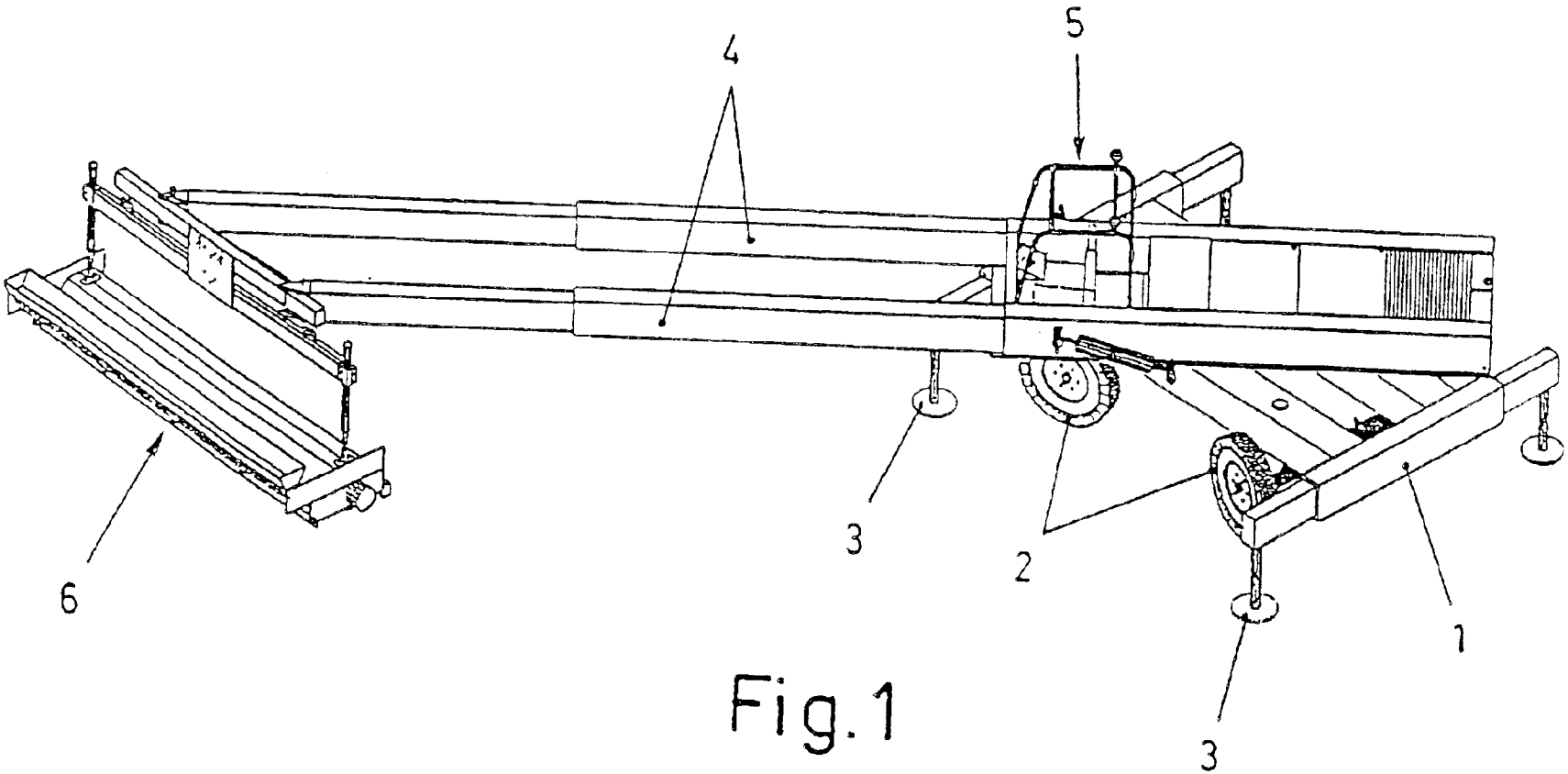
FIG. 1 shows a perspective of the preconized machine in working position.
Figure 2:
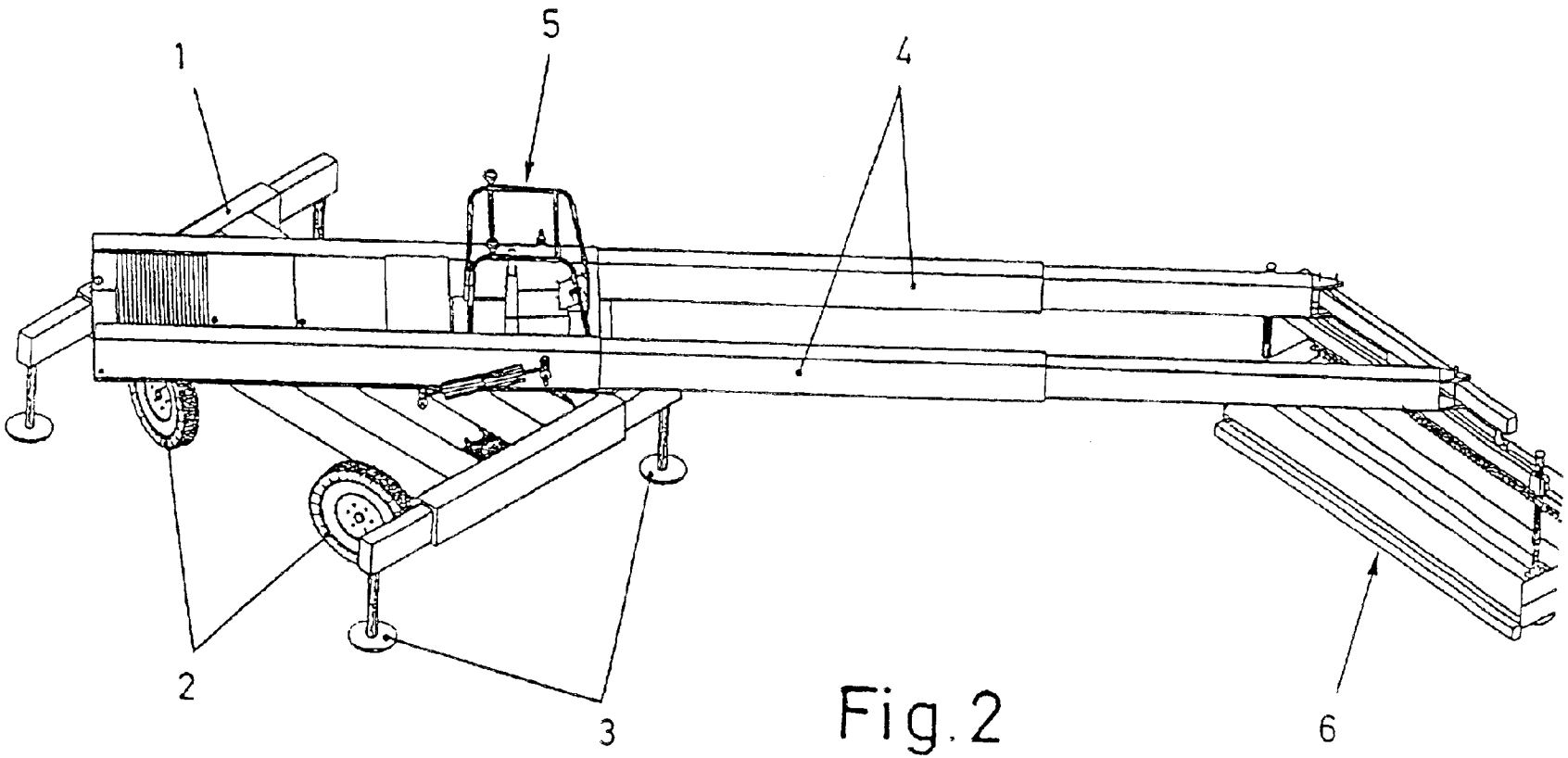
FIG. 2 is a perspective of the machine, observed from the other side, in the same working position.

The object of the invention refers to a machine destined to the levelling of materials extended over the ground, being the material levelling useful in any application which requires jobs of this type.

The machine includes a bearing structure (1), foreseen of rolling means (2) for the movement and means (3) for a fixed anchoring seating on the ground in the working disposition.

On the mentioned structure (1) an operative set is incorporated in revolving assembly foreseen of two structurally parallel telescopic arms (4), which can be extended and withdrawn by hydraulic means or by any other conventional operating system.

The revolving of the set which incorporates the arms (4), respect to the bearing structure (1), can also be actuated by any conventional system, be it hydraulic, mechanic, electric or of any other kind; being the actuation operative in a manual way from the control position (5) incorporated on the equipment, or by means of laser or infrared remote control, etc . . .

At the end of the arms (4) a head (6) is incorporated, which includes longitudinally at the lower part some worm and rollers (7), a screeding board (8) and a vibrating longitudinal beam (9), while at the upper part a chute (10) is incorporated.

The mentioned head (6) is fastened on the end of the arms (4), remaining hung by means of some cylinders (11) which allow a regulation of the height of positioning.

With all this, by means of the swinging of the set which incorporates the arms (4), respect to the bearing structure (1), the head (6) can be moved sideways, while by means of the extension and withdrawal of the arms (4), a frontal movement of the mentioned head (6) can be reached, moving away and coming nearer respect to the place where the machine is seated.

This way the head (6) can be dragged over the ground, where the worm and rollers (7) distribute the material which is extended, carrying out the screeding board (8) a levelling of the mentioned material at a uniform level, while the vibrating longitudinal beam (9) produces a compacting of the levelled material.

Through the chute (10) an accessory product can be delivered at the same time the levelling of the material extended on the ground is carried out, for example, an agglomerant or colouring agent on gravel, sand, or similar material, in work applications, or products to be sown on the ground that is smoothed up, in agricultural applications; these examples are not limitative, as the application can be any other where some similar functions are required.

Figure 6:
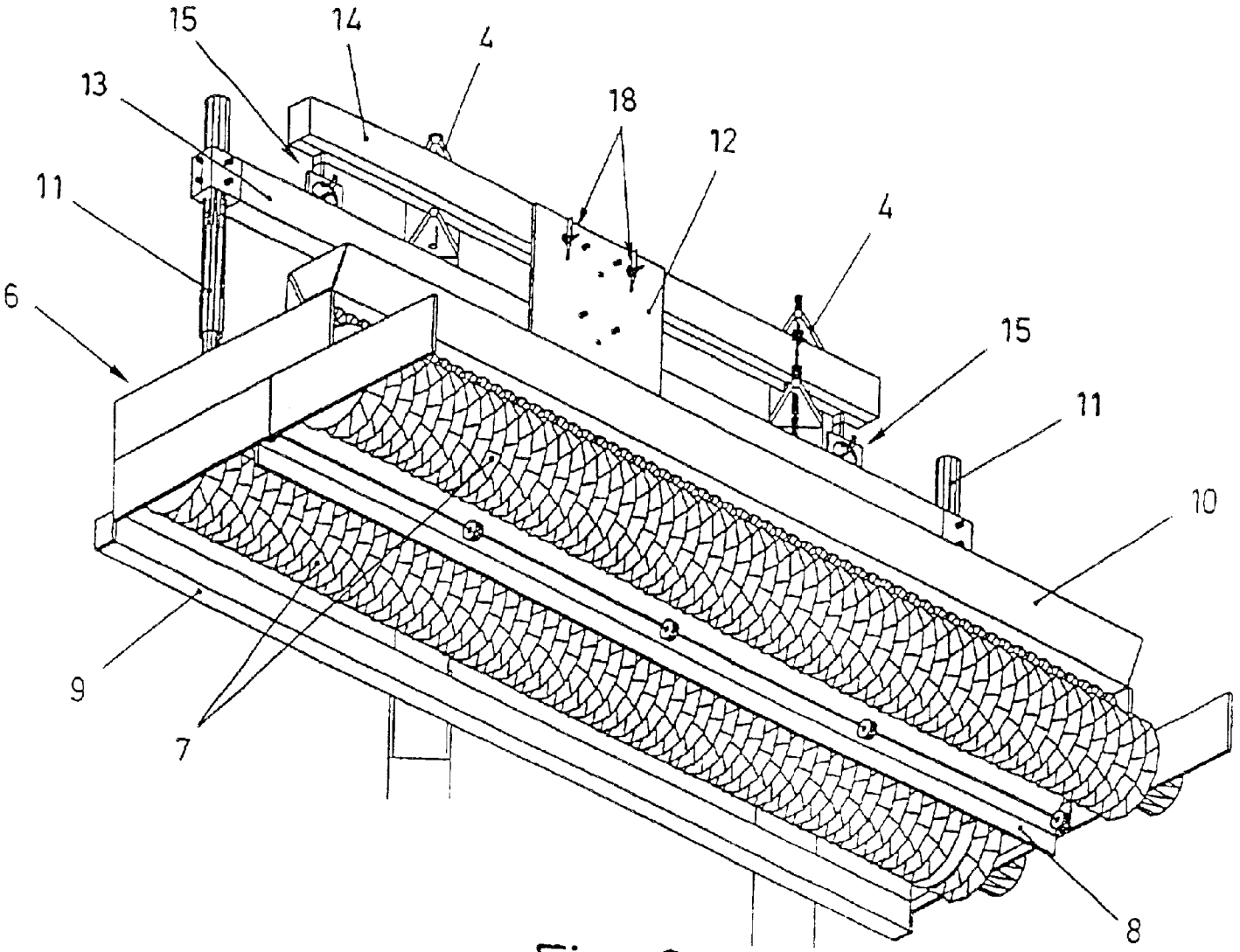
FIG. 6 is an enlarged perspective of the machine head observed from below.

The head (6) fastening respect to the arms (4) is established by means of an anchoring determined by means of anchoring (18) with wedges, between a solidary plate (12) of a longitudinal beam (13) of the bearing structure of the head (6) and a longitudinal beam (14) fixed on the ends of the arms (4) in the way it is observed on FIG. 6.

This way the head (6) can easily be disassembled from its incorporation into the machine, for the transport and is also easy to be assembled in its connection, for the job at the application sites.

Figure 7:
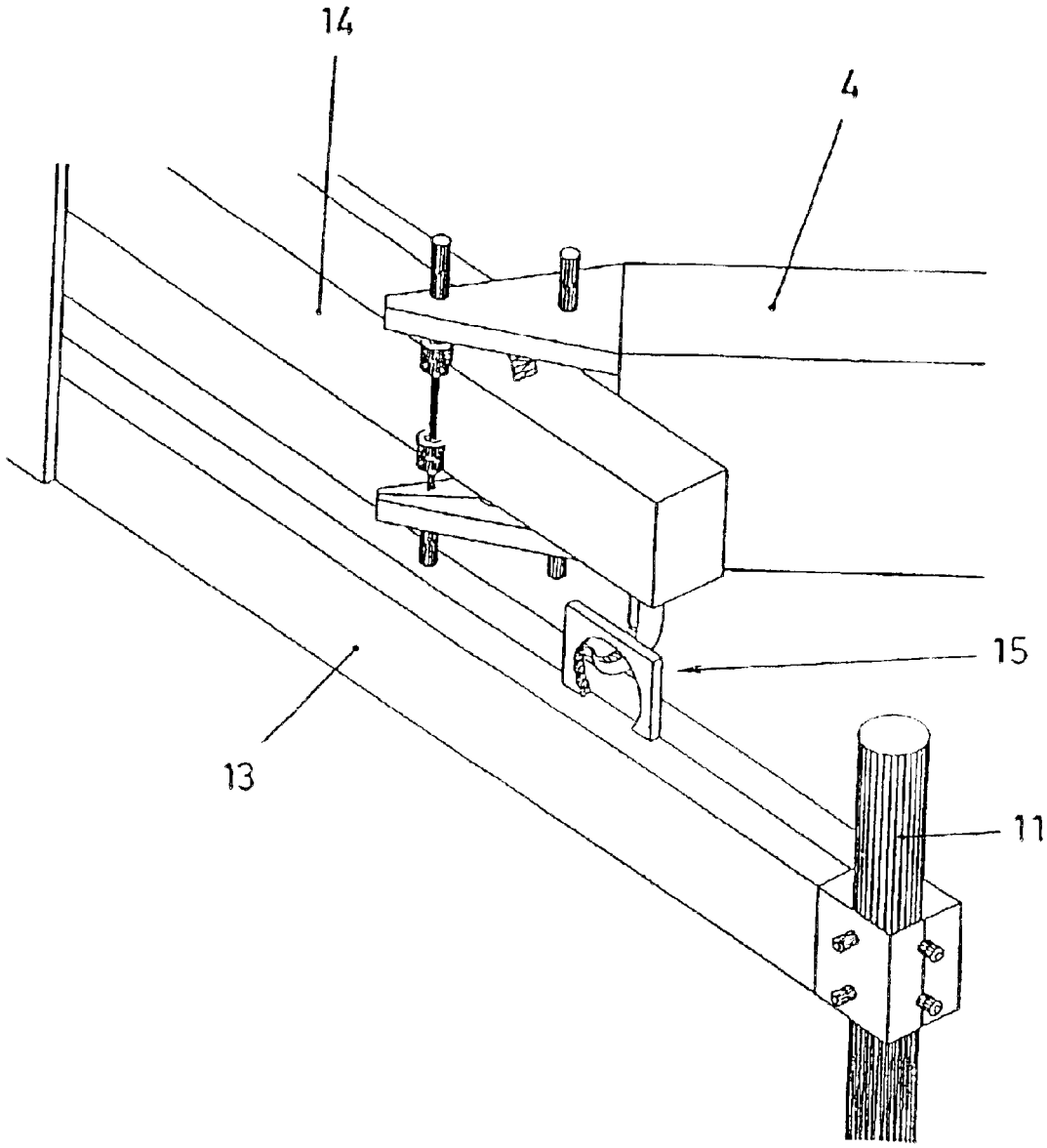
FIG. 7 is an enlarged detail of the head fastening respect to one of the supporting arms.

Between the longitudinal beam (14) fastened to the arms (4) and the longitudinal beam (13) of the bearing structure of the head (6), moreover some security hitches (15) are established, as it can be observed on FIGS. 6 and 7, by means of which the assembly and disassembly operations of the fastening are eased up, avoiding that the head (6) falls when the anchoring (18) is unblocked.

The extension and collection of the arms (4) can be activated in an independent way, while the fastening of the longitudinal beam (14) with respect to the mentioned arms (4) can be articulated, with which, when acting in combination with the arm extension (4) the head (6) can be situated from a perpendicular transversal position till selective transverse inclinations, to adapt a suitable the position in function of the work to be carried out in each case.

Figure 3:
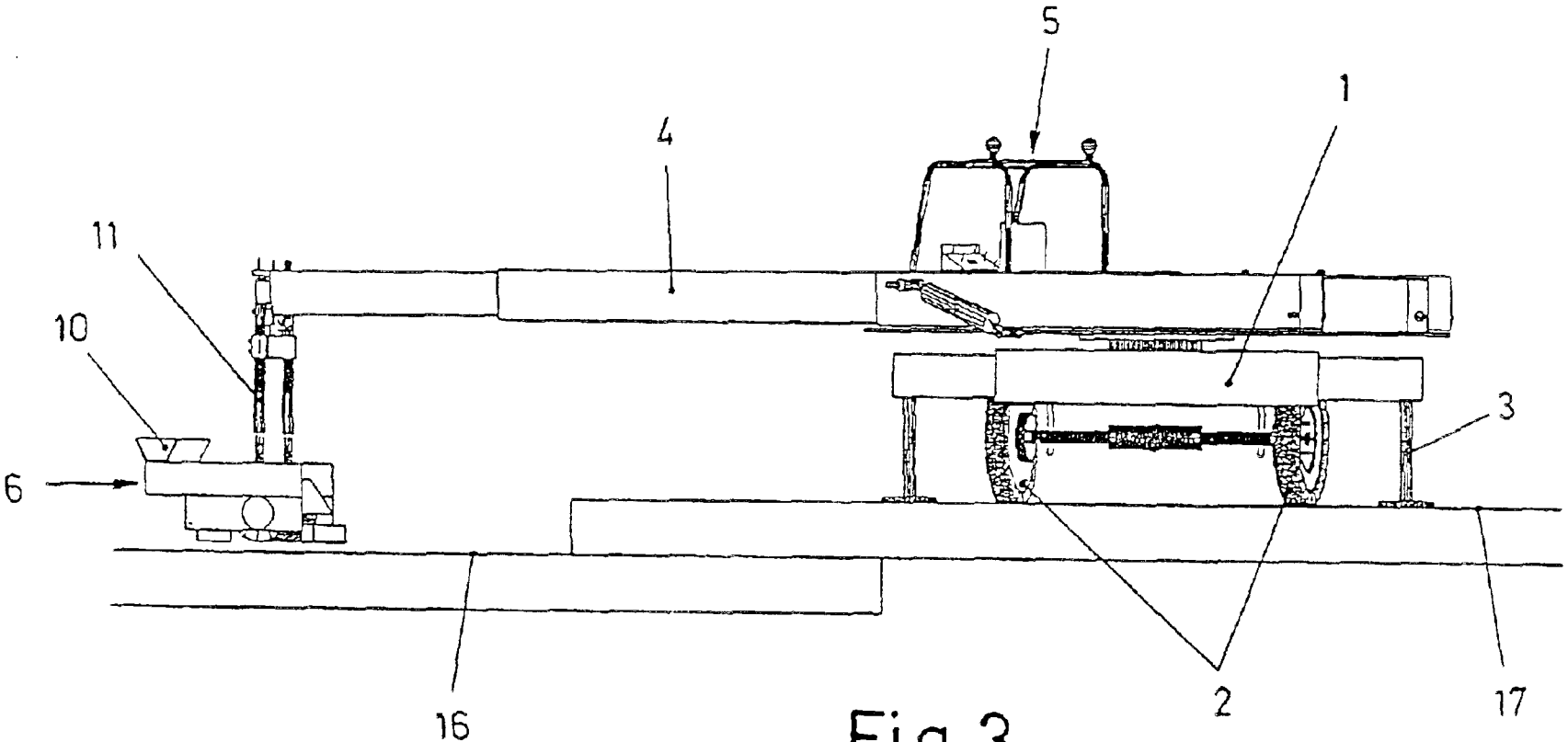
FIG. 3 is an elevation side view of the machine, in working position on a lower plane than the one where the machine is situated.
Figure 4:
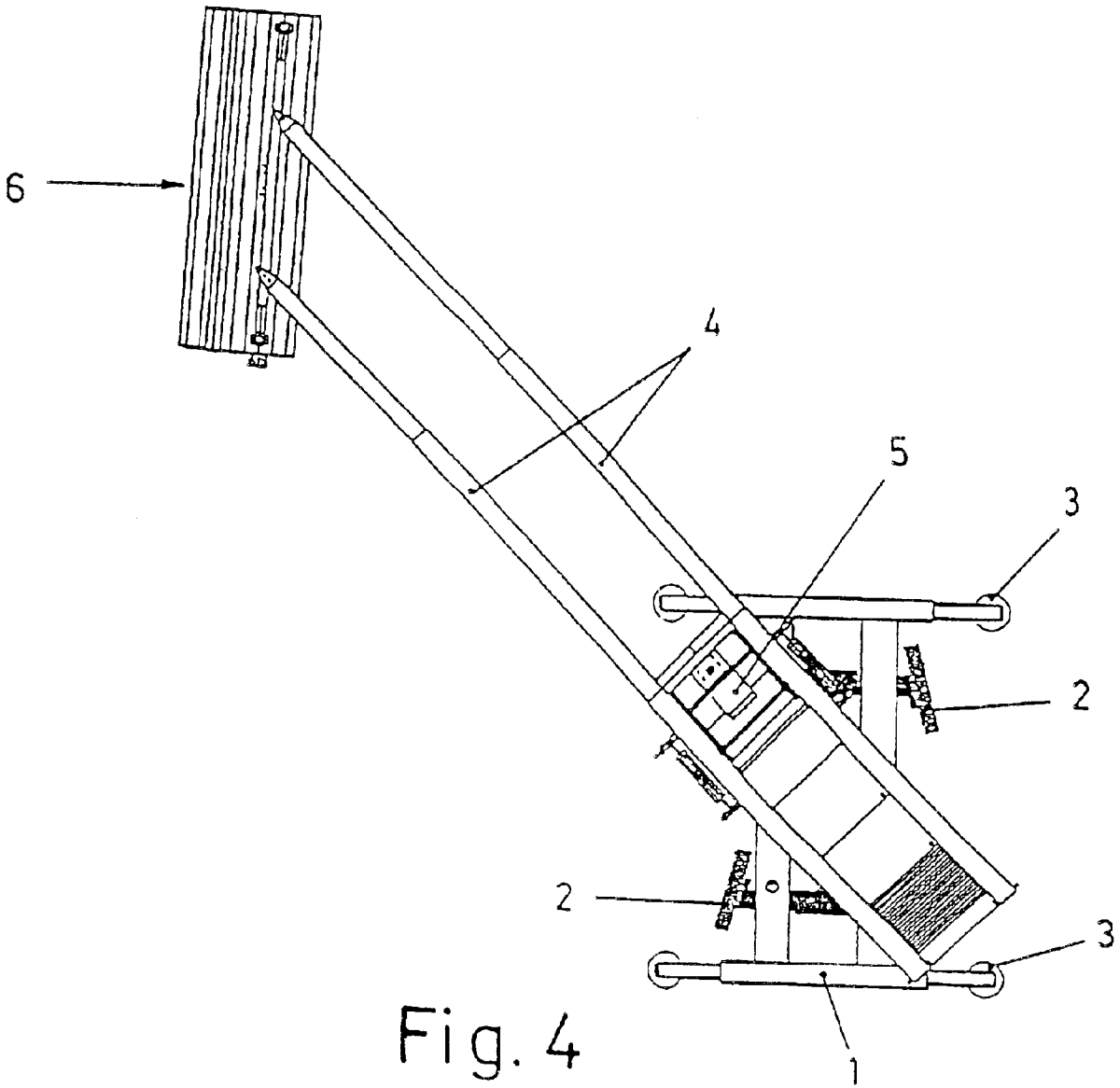
FIG. 4 is a top view of the machine in working position.
Figure 5:
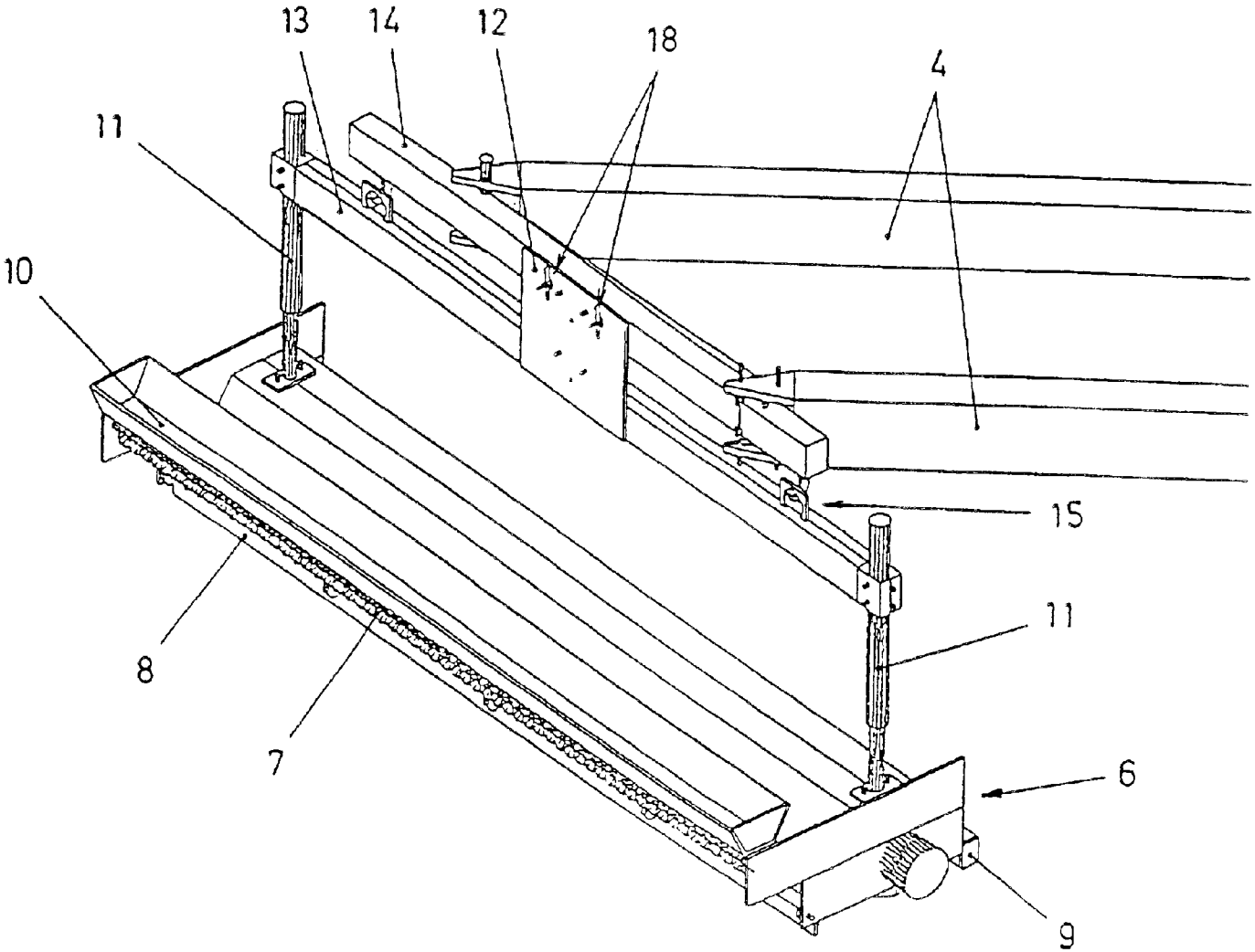
FIG. 5 is an enlarged perspective of the machine head, observed from above.

On the other hand, by means of the supporting cylinders (11) the height of the head (6) can be regulated, which allows the adaption to work on planes (16) which can be at the same level or at different levels from the plane (17) where the machine is established, as it can be observed on FIG. 3.

What is claimed is:

1. A machine to level materials on the ground comprising:

a prime mover, a turning assembly rotatably mounted on said prime mover about a vertical axis, a pair of individually telescopic tow arms, each connected at a first end to said turning assembly, a contouring assembly connected to a second end of said tow arms via a hanging assembly having a pair of downwardly dependent cylinders, said hanging assembly having an articulated connection to each of said tow arms, thereby said hanging assembly is permitted relative rotational motion about a vertical axis, relative to said tow arms, such that the contouring assembly can be oriented in oblique relation to the longitudinal axis of the telescopic arms by selective, individual extension and retraction of the telescopic arms.

2. The machine of claim 1, further comprising removable retention wedges, disposed substantially transverse to said longitudinal axis of said telescopic arms, that releasably anchor said head to said telescopic arms for assembly and disassembly.

3. The machine of claim 1, said head further comprising: a worm or roller device disposed at a lower part of said contouring assembly in a longitudinal direction thereof.

4. The machine of claim 3, further comprising two worm and roller devices.

5. The machine of claim 4, further comprising a screeding board disposed between said two worm and roller devices.

6. The machine of claim 4, further comprising a vibrating longitudinal beam disposed at a rear edge of said head.

7. The machine of claim 3, further comprising a chute to deliver an accessory product disposed at an upper part of said head.

8. The machine of claim 2, further comprising security hitches releasably connected between said head and said telescopic arms.

* * * * *